US010801499B2

(12) United States Patent
Kagawa

(10) Patent No.: US 10,801,499 B2
(45) Date of Patent: Oct. 13, 2020

(54) EXTERNAL GEAR PUMP

(71) Applicant: JTEKT CORPORATION, Osaka-shi (JP)

(72) Inventor: Hiroki Kagawa, Kashiba (JP)

(73) Assignee: JTEKT CORPORATION, Osaka-shi (JP)

( * ) Notice: Subject to any disclaimer, the term of this patent is extended or adjusted under 35 U.S.C. 154(b) by 148 days.

(21) Appl. No.: 16/101,955

(22) Filed: Aug. 13, 2018

(65) Prior Publication Data

US 2019/0063431 A1 Feb. 28, 2019

(30) Foreign Application Priority Data

Aug. 28, 2017 (JP) ..... 2017-163490

(51) Int. Cl.

| | |
|---|---|
| ***F04C 29/00*** | (2006.01) |
| ***F04C 11/00*** | (2006.01) |
| ***F04C 18/16*** | (2006.01) |
| ***F04C 2/08*** | (2006.01) |
| ***F04C 2/16*** | (2006.01) |

(Continued)

(52) U.S. Cl.

CPC ..... *F04C 29/0085* (2013.01); *F04C 2/08* (2013.01); *F04C 2/16* (2013.01); *F04C 2/18* (2013.01); *F04C 11/00* (2013.01); *F04C 11/001* (2013.01); *F04C 15/008* (2013.01); *F04C 18/16* (2013.01); *F04C 14/08* (2013.01); *F04C 2240/402* (2013.01); *F04C 2240/403* (2013.01); *F04C 2270/035* (2013.01)

(58) Field of Classification Search

CPC .. F04C 2240/402; F04C 11/00; F04C 11/001; F04C 2/08; F04C 2/082; F04C 2/084; F04C 2/12; F04C 2/14; F04C 2/16; F04C 2/18; F04C 15/008; F04C 29/0085; F04C 18/08; F04C 18/082; F04C 18/084; F04C 18/12; F04C 18/14; F04C 18/16; F04C 18/18

See application file for complete search history.

(56) References Cited

U.S. PATENT DOCUMENTS 3,257,035 A 6/1966 Jones
5,302,089 A * 4/1994 Maruyama ..... F01C 21/02 417/199.1

(Continued)

FOREIGN PATENT DOCUMENTS

| | | |
|---|---|---|
| CH | 416 482 | 6/1966 |
| EP | 2 275 683 A1 | 1/2011 |
| JP | 2016-118189 | 6/2016 |

*Primary Examiner* — Peter J Bertheaud

(74) *Attorney, Agent, or Firm* — Oblon, McClelland, Maier & Neustadt, L.L.P.

(57) ABSTRACT

An external gear pump includes a pump housing in which a pump chamber is formed, a primary gear having a plurality of external teeth housed in the pump chamber, a secondary gear having a plurality of external teeth that mesh with the plurality of external teeth of the primary gear in the pump chamber, a first electric motor configured to generate a torque for rotationally driving the primary gear, a second electric motor configured to generate a torque for rotationally driving the secondary gear, and a control unit configured to control the first and second electric motors. The control unit controls the first and second electric motors so that the torque generated by the first electric motor is greater than the torque generated by the second electric motor.

8 Claims, 7 Drawing Sheets

(51) Int. Cl.

| | |
|---|---|
| ***F04C 2/18*** | (2006.01) |
| ***F04C 15/00*** | (2006.01) |
| *F04C 14/08* | (2006.01) |

(56) References Cited

U.S. PATENT DOCUMENTS

| | | | | | |
|---|---|---|---|---|---|
| 5,393,201 | A * | 2/1995 | Okutani | F04C 28/28 | 417/16 |
| 5,478,210 | A * | 12/1995 | Maruyama | F04C 18/16 | 417/203 |
| 5,767,635 | A * | 6/1998 | Steffens | F04C 28/08 | 318/85 |
| 5,904,473 | A * | 5/1999 | Dahmlos | F01C 21/02 | 417/410.4 |
| 6,447,256 | B2 * | 9/2002 | Bussard | F04C 15/008 | 318/34 |
| 7,682,136 | B2 * | 3/2010 | Donoho, II | F01C 21/10 | 417/374 |
| 9,228,586 | B2 * | 1/2016 | Afshari | F04C 2/08 | |
| 9,719,507 | B2 * | 8/2017 | Krampe | F04C 2/084 | |
| 2010/0322805 | A1 | 12/2010 | Aregger | | |

* cited by examiner

SPEED CONTROL UNIT
CURRENT CONTROL UNIT
TWO-PHASE/THREE-PHASE CONVERSION UNIT
PWM CONTROL UNIT
INVERTER CIRCUIT
THREE-PHASE/TWO-PHASE CONVERSION UNIT
PHASE CALCULATION UNIT
SPEED CALCULATION UNIT
(Iseal−(Iq1−Iq2))×K
Δω
ω*
ω1
ω2
θ1
θ2
Iq1*
Vq1*
Vd1*
Iq1
Id1
Vu1*
Vv1*
Vw1*
Iq2*
Vq2*
Vd2*
Iq2
Id2
Vu2*
Vv2*
Vw2*
M
11
12
13
57
71
72
73
74
75
76
77
78
81
82
83
84
85
86
87
88
91
92
911
912
913
921
922
923
131
132

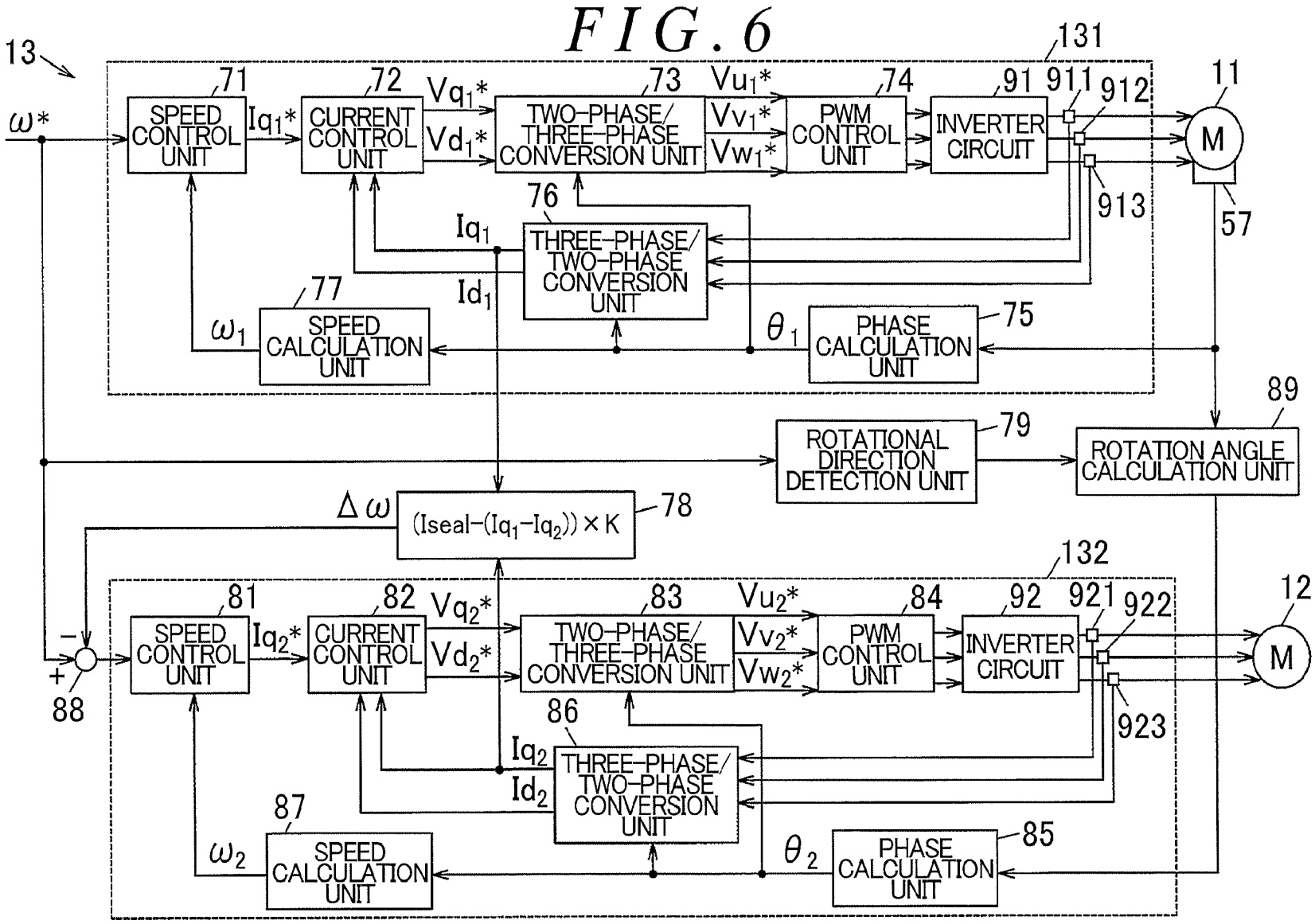
FIG. 6
13
ω*
SPEED CONTROL UNIT
71
Iq1*
CURRENT CONTROL UNIT
72
Vq1*
Vd1*
TWO-PHASE/THREE-PHASE CONVERSION UNIT
73
Vu1*
Vv1*
Vw1*
PWM CONTROL UNIT
74
INVERTER CIRCUIT
91
911
912
913
131
11
M
57
PHASE CALCULATION UNIT
75
θ1
THREE-PHASE/TWO-PHASE CONVERSION UNIT
76
Iq1
Id1
SPEED CALCULATION UNIT
77
ω1
ROTATIONAL DIRECTION DETECTION UNIT
79
ROTATION ANGLE CALCULATION UNIT
89
(Iseal−(Iq1−Iq2))×K
78
Δω
88
SPEED CONTROL UNIT
81
Iq2*
CURRENT CONTROL UNIT
82
Vq2*
Vd2*
TWO-PHASE/THREE-PHASE CONVERSION UNIT
83
Vu2*
Vv2*
Vw2*
PWM CONTROL UNIT
84
INVERTER CIRCUIT
92
921
922
923
132
12
M
PHASE CALCULATION UNIT
85
θ2
THREE-PHASE/TWO-PHASE CONVERSION UNIT
86
Iq2
Id2
SPEED CALCULATION UNIT
87
ω2

EXTERNAL GEAR PUMP

INCORPORATION BY REFERENCE

The disclosure of Japanese Patent Application No. 2017-163490 filed on Aug. 28, 2017 including the specification, drawings and abstract, is incorporated herein by reference in its entirety.

BACKGROUND OF THE INVENTION

1. Field of the Invention

The present invention relates to an external gear pump in which an electric motor serves as a drive source and external teeth of a first gear and external teeth of a second gear mesh with each other in a pump chamber.

2. Description of the Related Art

Hitherto, an external gear pump in which a driving gear to be driven by an electric motor and a driven gear to be rotated by meshing with the driving gear mesh with each other in a pump chamber and a fluid is sucked from a suction port and is discharged from a discharge port is used for various purposes (see, for example, Japanese Patent Application Publication No. 2016-118189 (JP 2016-118189 A)).

In the external gear pump described in JP 2016-118189 A, a rotational force of a rotation shaft of the electric motor is transmitted to the driving gear directly or via a speed reducing gear train. The electric motor is arranged in tandem with the pump chamber along an axial direction parallel to rotation axes of the driving gear and the driven gear.

In the external gear pump constructed as described above, the diameter of the electric motor is considerably larger than the diameters of the driving gear and the driven gear as illustrated in, for example, FIG. 1 and FIG. 2 of JP 2016-118189 A. Therefore, when the external gear pump is viewed in the axial direction, the electric motor significantly projects in a radial direction with respect to a housing at a part that forms the pump chamber. Thus, in a target apparatus on which the external gear pump is mounted, a space corresponding to the diameter of the electric motor needs to be secured as an arrangement space for the external gear pump. When the electric motor is simply downsized, a necessary discharge amount or a necessary discharge pressure cannot be secured.

SUMMARY OF THE INVENTION

It is one object of the present invention to provide an external gear pump in which its mountability on a target apparatus can be improved without a decrease in a discharge amount or a discharge pressure.

An external gear pump according to one aspect of the present invention includes:

a pump housing in which a pump chamber is formed;

a first gear having a plurality of external teeth housed in the pump chamber;

a second gear having a plurality of external teeth that mesh with the plurality of external teeth of the first gear in the pump chamber;

a first electric motor configured to generate a torque for rotationally driving the first gear;

a second electric motor configured to generate a torque for rotationally driving the second gear; and a control unit configured to control the first electric motor and the second electric motor.

The control unit is configured to control the first electric motor and the second electric motor so that the torque generated by the first electric motor is greater than the torque generated by the second electric motor.

According to the external gear pump of the aspect described above, the mountability of the external gear pump on the target apparatus can be improved without the decrease in the discharge amount or the discharge pressure.

BRIEF DESCRIPTION OF THE DRAWINGS

The foregoing and further features and advantages of the invention will become apparent from the following description of example embodiments with reference to the accompanying drawings, wherein like numerals are used to represent like elements and wherein:

FIG. 6 is a schematic configuration diagram illustrating an example of the configuration of a control unit according to the second embodiment.

DETAILED DESCRIPTION OF EMBODIMENTS

A first embodiment of the present invention is described with reference to FIG. 1 to FIG. 4.

Figure 1:
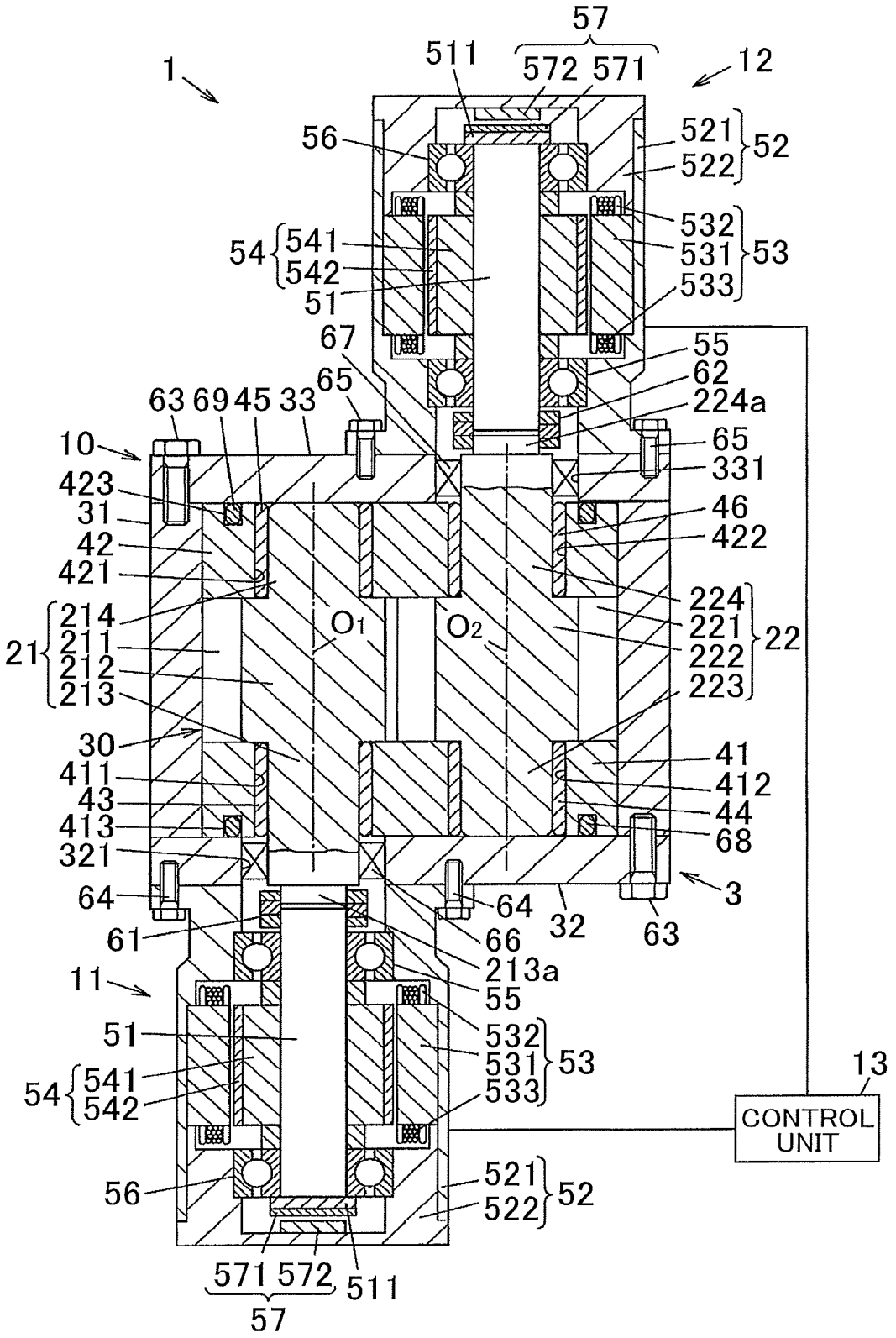
FIG. 1 is a sectional view illustrating an external gear pump according to a first embodiment of the present invention.
Figure 2:
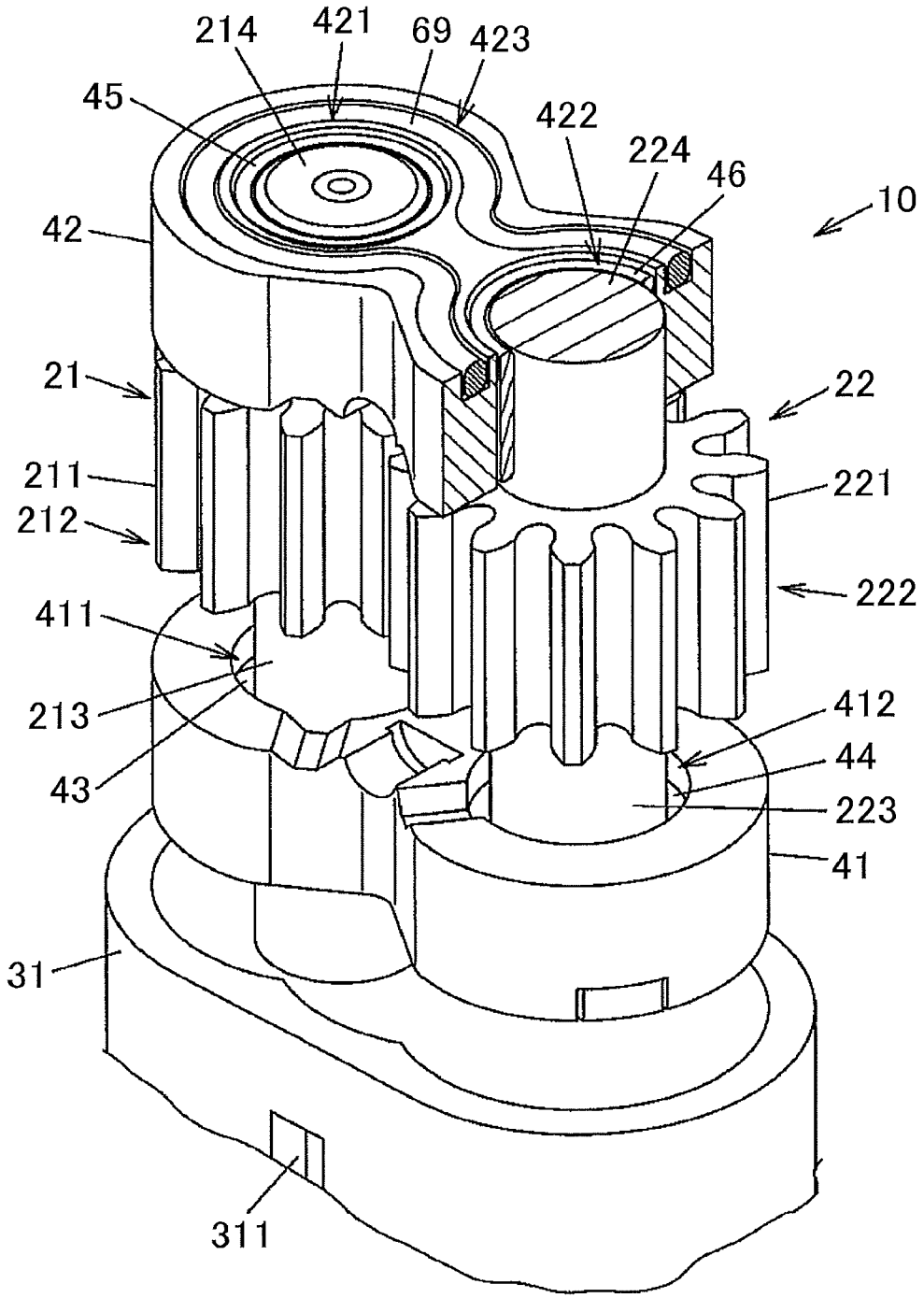
FIG. 2 is an exploded perspective view illustrating a pump unit of the external gear pump.
Figure 3:
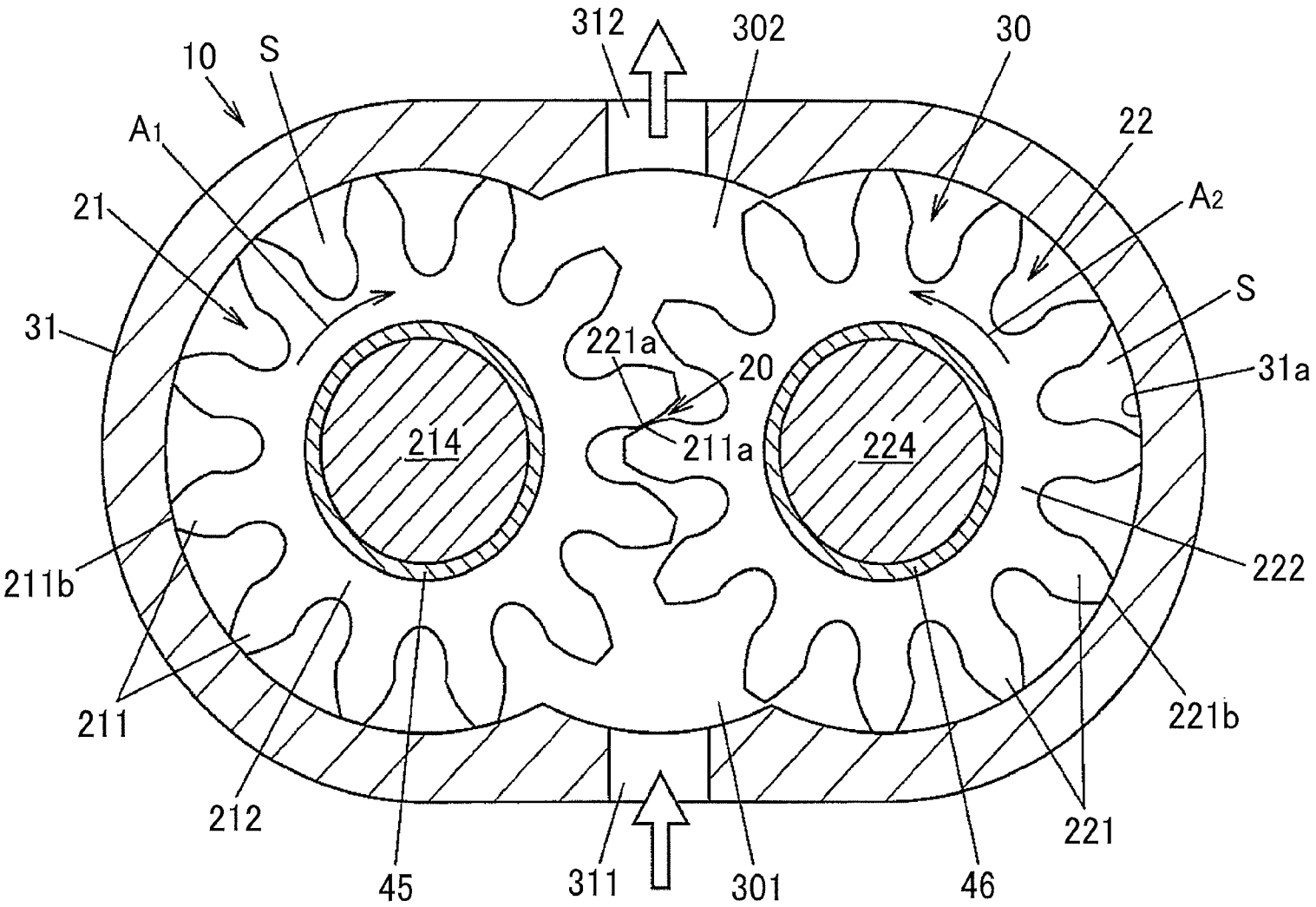
FIG. 3 is an explanatory drawing for describing an operation of the external gear pump.

FIG. 1 is a sectional view illustrating an external gear pump according to the first embodiment of the present invention. FIG. 2 is an exploded perspective view illustrating a pump unit of the external gear pump. FIG. 3 is an explanatory drawing for describing an operation of the external gear pump.

An external gear pump 1 includes a pump unit 10, first and second electric motors 11 and 12, and a control unit 13. The first and second electric motors 11 and 12 are drive sources of the pump unit 10. The control unit 13 controls the first and second electric motors 11 and 12. The first and second electric motors 11 and 12 are three-phase brushless motors. The pump unit 10 includes a primary gear 21, a secondary gear 22, a pump housing 3, a pair of side plates 41 and 42, and cylindrical plain bearings 43 to 46. The primary gear 21 serves as a first gear to be rotationally driven by the first electric motor 11. The secondary gear 22 serves as a second gear to be rotationally driven by the second electric motor 12. A pump chamber 30 is formed in the pump housing 3. The pump chamber 30 houses the primary gear 21 and the secondary gear 22. The side plates 41 and 42 are formed of a resin. The plain bearings 43 to 46 support the primary gear 21 and the secondary gear 22 so that the primary gear 21 and the secondary gear 22 are rotatable relative to the side plates 41 and 42.

The external gear pump 1 is mounted on a vehicle, and sucks hydraulic oil from a suction side and discharges the hydraulic oil to a discharge side through rotation of the primary gear 21 and the secondary gear 22. The hydraulic oil is used for an operation of an on-board apparatus. In FIG. 3, a suction direction and a discharge direction of the hydraulic oil are indicated by outline arrows. For example, the on-board apparatus is an electro-hydraulic power steering system. The hydraulic oil discharged from the external gear pump 1 is supplied to a power cylinder, thereby applying, as a steering assist force, an axial movement force to a rack shaft that turns steered wheels of the vehicle.

The first electric motor 11 includes a motor shaft 51, a motor housing 52, an annular stator 53, a rotor 54, first and second rolling bearings 55 and 56, and a rotation angle sensor 57. The motor shaft 51 is a rotation shaft. The stator 53 is held by the motor housing 52. The rotor 54 is arranged on an inner side of the stator 53. The first and second rolling bearings 55 and 56 support the motor shaft 51. The rotation angle sensor 57 detects a rotation angle of the motor shaft 51 with respect to the stator 53.

The motor housing 52 includes a tubular body 521 and a lid 522 that closes one end of the body 521. The body 521 is fixed to the pump housing 3. For example, the lid 522 is fixed to the body 521 with bolts (not illustrated). The stator 53 includes a core 531, insulators 532, and windings 533. The insulators 532 are attached to the core 531. The windings 533 are wound around the insulators 532. A motor current is supplied from the control unit 13 to the windings 533. The rotor 54 includes a core 541 and a plurality of permanent magnets 542. The core 541 is fixed to the motor shaft 51. The permanent magnets 542 are attached to the outer peripheral surface of the core 541. The rotation angle sensor 57 includes a permanent magnet 571 and a magnetic sensor 572. The permanent magnet 571 is fixed to a flange 511 provided at one end of the motor shaft 51, and has a plurality of magnetic poles. The magnetic sensor 572 is fixed to the lid 522 of the motor housing 52, and detects a magnetic field of the magnetic poles of the permanent magnet 571. A detection signal of the magnetic sensor 572 is transmitted to the control unit 13.

Similarly to the first electric motor 11, the second electric motor 12 includes a motor shaft 51, a motor housing 52, a stator 53, a rotor 54, and first and second rolling bearings 55 and 56. In FIG. 1, components of the second electric motor 12 that are in common with the components of the first electric motor 11 are represented by the same reference symbols to omit redundant description. In this embodiment, the outside diameter of the first electric motor 11 (diameter of the outer peripheral surface of the motor housing 52) is equal to the outside diameter of the second electric motor 12. As described later, a torque generated by the second electric motor 12 is smaller than a torque generated by the first electric motor 11, and therefore the outside diameter of the second electric motor 12 may be set smaller than the outside diameter of the first electric motor 11.

The primary gear 21 integrally includes a gear portion 212, a first shaft portion 213, and a second shaft portion 214. The gear portion 212 is provided with a plurality of external teeth 211. The first shaft portion 213 protrudes to one side in an axial direction from a central part of the gear portion 212. The second shaft portion 214 protrudes to the other side in the axial direction from the central part of the gear portion 212. A distal end 213*a* of the first shaft portion 213 is coupled to the motor shaft 51 of the first electric motor 11 by a coupling (shaft coupling) 61. The first electric motor 11 is supplied with a motor current from the control unit 13 to generate a torque for rotationally driving the primary gear 21. The primary gear 21 is housed in the pump housing 3 except for the distal end 213*a* of the first shaft portion 213.

Similarly to the primary gear 21, the secondary gear 22 integrally includes a gear portion 222, a first shaft portion 223, and a second shaft portion 224. The gear portion 222 is provided with a plurality of external teeth 221. The first shaft portion 223 protrudes to one side in the axial direction from a central part of the gear portion 222. The second shaft portion 224 protrudes to the other side in the axial direction from the central part of the gear portion 222. A distal end 224*a* of the second shaft portion 224 is coupled to the motor shaft 51 of the second electric motor 12 by a coupling 62. The second electric motor 12 is supplied with a motor current from the control unit 13 to generate a torque for rotationally driving the secondary gear 22. The secondary gear 22 is housed in the pump housing 3 except for the distal end 224*a* of the second shaft portion 224. The second electric motor 12 rotates the secondary gear 22 in a direction opposite to that of the primary gear 21.

The external teeth 211 of the primary gear 21 and the external teeth 221 of the secondary gear 22 mesh with each other in the pump chamber 30. A tooth flank 211*a* of at least one external tooth 211 of the primary gear 21 is in contact with a tooth flank 221*a* of at least one external tooth 221 of the secondary gear 22, and the contact portion forms a seal portion 20. The seal portion 20 defines a low-pressure chamber 301 and a high-pressure chamber 302 in the pump chamber 30.

The pump housing 3 includes a tubular portion 31 and first and second side plate portions 32 and 33. The tubular portion 31 has an inner surface 31*a* that faces tip surfaces 211*b* and 221*b* (see FIG. 3) of the external teeth 211 and 221 of the primary gear 21 and the secondary gear 22. The tubular portion 31 is interposed between the first and second side plate portions 32 and 33 in its central axis direction. The first and second side plate portions 32 and 33 have a flat-plate shape, and are fixed to the tubular portion 31 with a plurality of bolts 63. A suction port 311 and a discharge port 312 are formed in the tubular portion 31. The hydraulic oil is sucked into the pump chamber 30 through the suction port 311. The hydraulic oil is discharged from the pump chamber 30 through the discharge port 312.

An insertion hole 321 is formed in the first side plate portion 32. The first shaft portion 213 of the primary gear 21 is inserted through the insertion hole 321. A seal member 66 is arranged between the inner peripheral surface of the insertion hole 321 and the outer peripheral surface of the first shaft portion 213. An insertion hole 331 is formed in the second side plate portion 33. The second shaft portion 224 of the secondary gear 22 is inserted through the insertion hole 331. A seal member 67 is arranged between the inner peripheral surface of the insertion hole 331 and the outer peripheral surface of the second shaft portion 224. The seal members 66 and 67 prevent leakage of the hydraulic oil from the pump housing 3 to the first electric motor 11 and the second electric motor 12, respectively.

The first electric motor 11 is arranged on one side in an axial direction of the pump chamber 30 that is parallel to a rotation axis $O_1$ of the primary gear 21 and a rotation axis $O_2$ of the secondary gear 22. The second electric motor 12 is arranged on the other side in the axial direction of the pump chamber 30. The motor housing 52 of the first electric motor 11 is fixed to the first side plate portion 32 with a plurality of bolts 64. The motor housing 52 of the second electric motor 12 is fixed to the second side plate portion 33 with a plurality of bolts 65.

In this embodiment, the outside diameter of the first electric motor 11 and the outside diameter of the second electric motor 12 are smaller than a thickness of the pump housing 3 in a direction perpendicular to an imaginary plane including the rotation axes $O_1$ and $O_2$. The outside diameter of the first electric motor 11 and the outside diameter of the second electric motor 12 may be equal to or larger than the thickness of the pump housing 3 in the direction described above. When the outside diameter of the first electric motor 11 and the outside diameter of the second electric motor 12 are smaller than the thickness of the pump housing 3 in the direction described above, the mountability of the external gear pump 1 on the vehicle is further improved.

One side plate 41 out of the pair of side plates 41 and 42 is arranged between each of the gear portions 212 and 222 of the primary gear 21 and the secondary gear 22 and the first side plate portion 32. The other side plate 42 is arranged between each of the gear portions 212 and 222 of the primary gear 21 and the secondary gear 22 and the second side plate portion 33.

An insertion hole 411 and an insertion hole 412 are formed in the one side plate 41. The first shaft portion 213 of the primary gear 21 is inserted through the insertion hole 411. The first shaft portion 223 of the secondary gear 22 is inserted through the insertion hole 412. The plain bearing 43 that supports the first shaft portion 213 of the primary gear 21 is internally fitted to the insertion hole 411. The plain bearing 44 that supports the first shaft portion 223 of the secondary gear 22 is internally fitted to the insertion hole 412. An annular groove 413 is formed on a surface of the side plate 41 that faces the first side plate portion 32. The annular groove 413 houses a side seal 68 formed of an elastic body such as rubber.

An insertion hole 421 and an insertion hole 422 are formed in the other side plate 42. The second shaft portion 214 of the primary gear 21 is inserted through the insertion hole 421. The second shaft portion 224 of the secondary gear 22 is inserted through the insertion hole 422. The plain bearing 45 that supports the second shaft portion 214 of the primary gear 21 is internally fitted to the insertion hole 421. The plain bearing 46 that supports the second shaft portion 224 of the secondary gear 22 is internally fitted to the insertion hole 422. An annular groove 423 is formed on a surface of the side plate 42 that faces the second side plate portion 33. The annular groove 423 houses a side seal 69 formed of an elastic body such as rubber.

In the external gear pump 1 constructed as described above, the primary gear 21 is rotationally driven by the torque of the first electric motor 11, and the secondary gear 22 is rotationally driven by the torque of the second electric motor 12. Thus, the hydraulic oil sucked from the suction port 311 is discharged from the discharge port 312. In FIG. 3, the rotational directions of the primary gear 21 and the secondary gear 22 are indicated by arrows $A_1$ and $A_2$, respectively. The first electric motor 11 and the second electric motor 12 rotate the primary gear 21 and the secondary gear 22 in one direction, respectively.

Oil chambers S are formed between two external teeth 211 of the primary gear 21 that are adjacent to each other in a circumferential direction and between two external teeth 221 of the secondary gear 22 that are adjacent to each other in the circumferential direction. The hydraulic oil sucked from the suction port 311 is moved from the low-pressure chamber 301 to the high-pressure chamber 302 by the oil chambers S along with the rotation of the primary gear 21 and the secondary gear 22. In the high-pressure chamber 302, the pressure of the hydraulic oil is increased by a volume change caused by the meshing between the external teeth 211 of the primary gear 21 and the external teeth 221 of the secondary gear 22, thereby discharging the hydraulic oil from the discharge port 312.

Next, the configuration of the control unit 13 is described with reference to FIG. 4.

Figure 4:
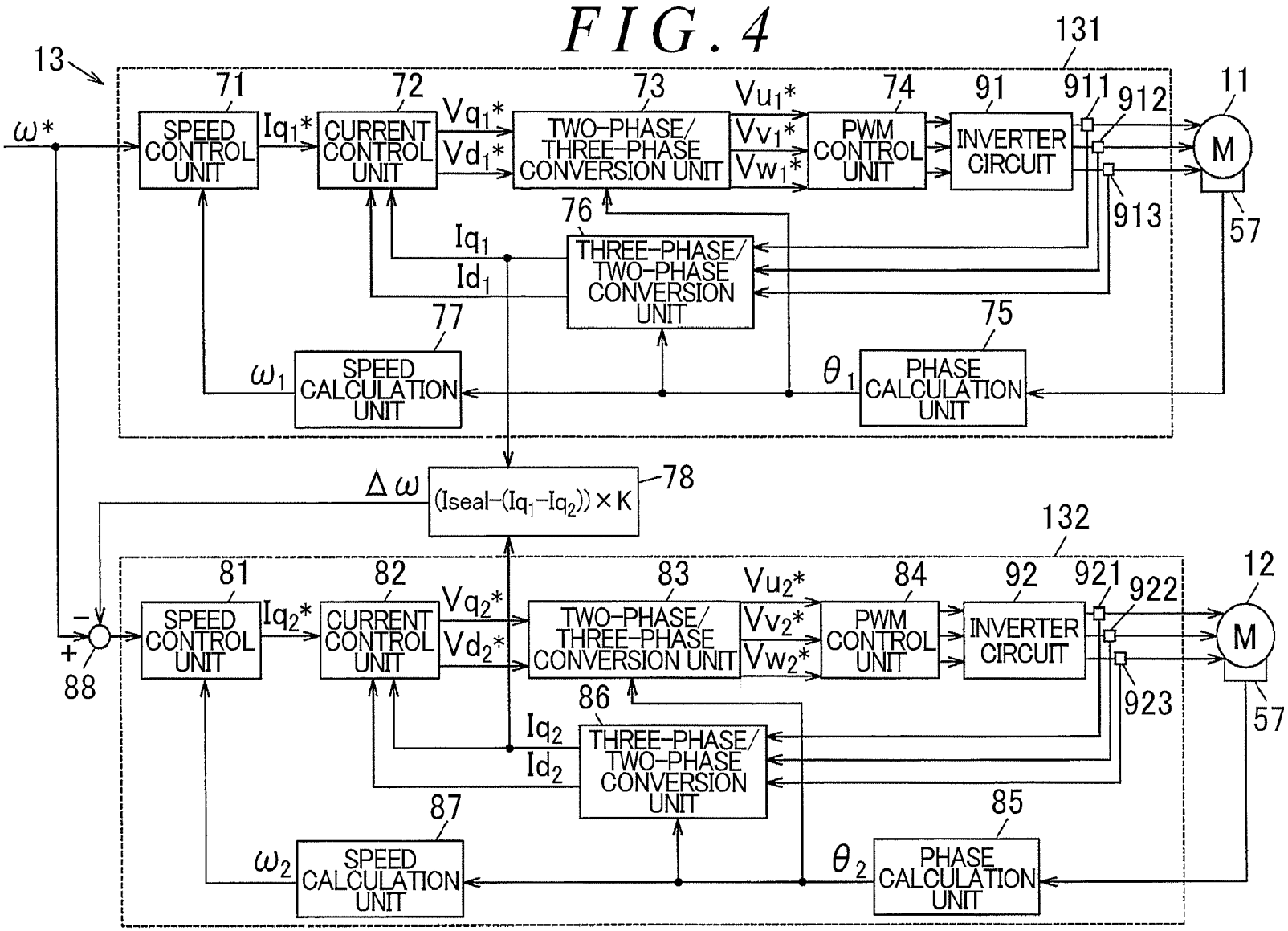
FIG. 4 is a schematic configuration diagram illustrating an example of the configuration of a control unit.

FIG. 4 is a schematic configuration diagram illustrating an example of the configuration of the control unit 13. When a central processing unit (CPU) executes a program stored in advance, the control unit 13 functions as speed control units 71 and 81, current control units 72 and 82, two-phase/three-phase conversion units 73 and 83, pulse width modulation (PWM) control units 74 and 84, phase calculation units 75 and 85, three-phase/two-phase conversion units 76 and 86, speed calculation units 77 and 87, a command speed difference calculation unit 78, and a subtraction unit 88. The CPU of the control unit 13 executes each type of processing described later in every predetermined calculation period. For example, the calculation period is 5 ms. The control unit 13 includes inverter circuits 91 and 92 and current sensors 911 to 913 and 921 to 923. The inverter circuits 91 and 92 include a plurality of switching elements. The current sensors 911 to 913 and 921 to 923 detect U-phase, V-phase, and W-phase currents output from the inverter circuits 91 and 92, respectively.

The speed control unit 71, the current control unit 72, the two-phase/three-phase conversion unit 73, the PWM control unit 74, the phase calculation unit 75, the three-phase/two-phase conversion unit 76, the speed calculation unit 77, the inverter circuit 91, and the current sensors 911 to 913 constitute a first control block 131 for controlling the first electric motor 11. The speed control unit 81, the current control unit 82, the two-phase/three-phase conversion unit 83, the PWM control unit 84, the phase calculation unit 85, the three-phase/two-phase conversion unit 86, the speed calculation unit 87, the inverter circuit 92, and the current sensors 921 to 923 constitute a second control block 132 for controlling the second electric motor 12.

The first control block 131 receives a rotation speed command $\omega^*$ from a higher-level controller (not illustrated), and the rotation speed command $\omega^*$ is input to the speed control unit 71.

In the first control block 131, the speed control unit 71 calculates a q-axis current command value $Iq_1^*$ that is a target value of a torque component of the motor current to be supplied to the first electric motor 11 by performing proportional-integral calculation (PI calculation) on a deviation $(\omega^*-\omega_1)$ between the rotation speed command $\omega^*$ and an actual rotation speed $\omega_1$ that is calculated by the speed calculation unit 77 described later and indicates an actual rotation speed of the first electric motor 11. The current control unit 72 calculates a q-axis voltage command value $Vq_1^*$ and a d-axis voltage command value $Vd_1^*$ by performing proportional-integral calculation based on the q-axis current command value $Iq_1^*$ calculated by the speed control unit 71 and a q-axis current detection value $Iq_1$ and a d-axis current detection value $Id_1$ that are calculated by the three-phase/two-phase conversion unit 76 described later.

The two-phase/three-phase conversion unit 73 converts the q-axis voltage command value $Vq_1^*$ and the d-axis voltage command value $Vd_1^*$ into U-phase, V-phase, and W-phase voltage command values $Vu_1^*$, $Vv_1^*$, and $Vw_1^*$ by using a rotation angle $\theta_1$ calculated by the phase calculation unit 75 described later. The PWM control unit 74 generates a U-phase PWM control signal, a V-phase PWM control signal, and a W-phase PWM control signal having duties corresponding to the three-phase voltage command values $Vu_1$*, $Vv_1$*, and $Vw_1$*, respectively, and supplies the U-phase PWM control signal, the V-phase PWM control signal, and the W-phase PWM control signal to the inverter circuit 91. The inverter circuit 91 turns ON or OFF the switching elements based on the PWM control signals of the respective phases, and supplies three-phase alternating currents to the first electric motor 11 as motor currents.

The phase calculation unit 75 calculates the rotation angle $\theta_1$ of the motor shaft 51 of the first electric motor 11 based on a detection signal from the rotation angle sensor 57 of the first electric motor 11. The three-phase/two-phase conversion unit 76 converts the currents of the respective phases that are determined by the current sensors 911 to 913 into the q-axis current detection value $Iq_1$ and the d-axis current detection value $Id_1$ by using the rotation angle $\theta_1$ calculated by the phase calculation unit 75. One current sensor out of the current sensors 911 to 913 may be omitted based on a relationship in which the sum of the U-phase, V-phase, and W-phase currents is zero. The speed calculation unit 77 calculates the rotation speed of the first electric motor 11 in every predetermined calculation period. Specifically, the speed calculation unit 77 calculates the actual rotation speed $\psi_1$ based on a difference between a rotation angle $\theta_1$ of a previous calculation period and a rotation angle $\theta_1$ of a current calculation period.

A value obtained such that a command speed difference $\Delta\omega$ calculated by the command speed difference calculation unit 78 described later is subtracted from the rotation speed command $\omega$* by the subtraction unit 88 is input to the speed control unit 81 of the second control block 132. Operations of the second control block 132 other than this operation are similar to those of the first control block 131.

That is, the speed control unit 81 of the second control block 132 calculates a q-axis current command value $Iq_2$* that is a target value of a torque component of the motor current to be supplied to the second electric motor 12 by performing proportional-integral calculation on a deviation between the value ($\omega$*−$\Delta\omega$) calculated by the subtraction unit 88 and an actual rotation speed $\omega_2$ of the second electric motor 12 that is calculated by the speed calculation unit 87. The current control unit 82 calculates a q-axis voltage command value $Vq_2$* and a d-axis voltage command value $Vd_2$* based on the q-axis current command value $Iq_2$* and a q-axis current detection value $Iq_2$ and a d-axis current detection value $Id_2$ that are calculated by the three-phase/two-phase conversion unit 86. The two-phase/three-phase conversion unit 83 converts the q-axis voltage command value $Vq_2$* and the d-axis voltage command value $Vd_2$* into U-phase, V-phase, and W-phase voltage command values $Vu_2$*, $Vv_2$*, and $Vw_2$* by using a rotation angle $\theta_2$ of the second electric motor 12 that is calculated by the phase calculation unit 85.

The PWM control unit 84 generates PWM control signals of the respective phases that have duties corresponding to the three-phase voltage command values $Vu_2$*, $Vv_2$* , and $Vw_2$* , respectively, and supplies the PWM control signals to the inverter circuit 92. The inverter circuit 92 supplies three-phase alternating currents to the second electric motor 12 as motor currents. The phase calculation unit 85 calculates the rotation angle $\theta_2$ based on a detection signal from the rotation angle sensor 57 of the second electric motor 12. The three-phase/two-phase conversion unit 86 converts the currents of the respective phases that are determined by the current sensors 921 to 923 into the q-axis current detection value $Iq_2$ and the d-axis current detection value $Id_2$ by using the rotation angle $\theta_2$.

The command speed difference calculation unit 78 calculates, as the command speed difference $\Delta\omega$, a value obtained such that a value obtained by subtracting a difference ($Iq_1$-$Iq_2$) between the q-axis current detection value $Iq_1$ and the q-axis current detection value $Iq_2$ from a current value Iseal is multiplied by a predetermined coefficient K. The current value Iseal is a current value for causing a torque difference between the first electric motor 11 and the second electric motor 12 so that the torque generated by the first electric motor 11 is greater than the torque generated by the second electric motor 12. As the current value Iseal increases, the difference between the torque generated by the first electric motor 11 and the torque generated by the second electric motor 12 increases. The torque difference increases a contact pressure between the tooth flank 211*a* of the external tooth 211 of the primary gear 21 and the tooth flank 221*a* of the external tooth 221 of the secondary gear 22 at the seal portion 20. In other words, the current value Iseal secures the sealability of the seal portion 20.

For example, the current value Iseal may be a predetermined constant, but may be a variable that increases as the q-axis current detection value $Iq_1$, the q-axis current detection value $Iq_2$, or an average of the q-axis current detection value $Iq_1$ and the q-axis current detection value $Iq_2$ increases. Alternatively, the current value Iseal may be a variable that increases as the discharge pressure of the external gear pump 1 increases. When the current value Iseal is a variable, the current value Iseal may be determined based on a map stored in advance in a non-volatile memory of the control unit 13, or based on a mathematical expression using a program function.

The coefficient K is a unit conversion coefficient for determining the command speed difference $\Delta\omega$ based on a value (Iseal-($Iq_1$-$Iq_2$)) determined as a current value. The coefficient K may be regarded as a gain because the command speed difference $\Delta\omega$ increases as the value of the coefficient K increases. Through the calculation of the command speed difference $\Delta\omega$ based on the q-axis current detection value $Iq_1$ and the q-axis current detection value $Iq_2$ by the command speed difference calculation unit 78, the second control block 132 controls the second electric motor 12 so that the value obtained by subtracting the q-axis current detection value $Iq_2$ from the q-axis current detection value $Iq_1$ is equal to the current value Iseal, in other words, the q-axis current detection value $Iq_2$ is a value obtained by subtracting the current value Iseal from the q-axis current detection value $Iq_1$. Thus, the sealability of the seal portion 20 is secured, thereby preventing leakage of the hydraulic oil from the high-pressure chamber 302 to the low-pressure chamber 301 in the pump chamber 30.

The above description of the operations of the respective portions of the external gear pump 1 is directed to a case where the respective portions function properly. Even if one gear out of the primary gear 21 and the secondary gear 22 cannot rotationally be driven due to a failure, the control unit 13 of the external gear pump 1 according to this embodiment causes the primary gear 21 and the secondary gear 22 to rotate by continuing the rotational drive of the other gear. More specifically, when a failure occurs such that the primary gear 21 cannot rotationally be driven by the first electric motor 11, the control unit 13 causes the secondary gear 22 to rotate by controlling the second electric motor 12 and causes the primary gear 21 to rotate by the meshing between the primary gear 21 and the secondary gear 22.

When a failure occurs such that the secondary gear 22 cannot rotationally be driven by the second electric motor 12, the control unit 13 causes the primary gear 21 to rotate by controlling the first electric motor 11 and causes the secondary gear 22 to rotate by the meshing between the secondary gear 22 and the primary gear 21.

For example, when a failure occurs in the first electric motor 11 or the inverter circuit 91, the primary gear 21 cannot rotationally be driven by the first electric motor 11. When a failure occurs in the second electric motor 12 or the inverter circuit 92, the secondary gear 22 cannot rotationally be driven by the second electric motor 12.

When a failure occurs such that the primary gear 21 cannot rotationally be driven by the first electric motor 11, the cooperative control of the first electric motor 11 and the second electric motor 12 by the command speed difference calculation unit 78 and the subtraction unit 88 is disabled, and the rotation speed command ω* is input to the speed control unit 81 of the second control block 132 without the subtraction by the subtraction unit 88. Further, a torque greater than that before the failure occurs is generated in the second electric motor 12 by, for example, increasing the gain of the PI calculation performed by the current control unit 82.

When a failure occurs such that the secondary gear 22 cannot rotationally be driven by the second electric motor 12, the cooperative control of the first electric motor 11 and the second electric motor 12 by the command speed difference calculation unit 78 and the subtraction unit 88 is disabled, and a torque greater than that before the failure occurs is generated in the first electric motor 11 by, for example, increasing the gain of the PI calculation performed by the current control unit 72.

Thus, even if one gear out of the primary gear 21 and the secondary gear 22 cannot rotationally be driven, the pump operation in which the hydraulic oil is sucked into the pump chamber 30 and is discharged from the pump chamber 30 can be continued by continuing the rotational drive of the other gear. For example, the occurrence of a failure can be detected when the current values detected by the current sensors 911 to 913 or the current sensors 921 to 923 deviate from normal operation ranges.

According to the first embodiment described above, the primary gear 21 and the secondary gear 22 of the pump unit 10 are rotationally driven by the first and second electric motors 11 and 12, respectively. Therefore, the outside diameters of the first and second electric motors 11 and 12 can be reduced without a decrease in the discharge amount or the discharge pressure as compared to, for example, a case where the pump unit 10 is driven by a single electric motor. Thus, it is possible to improve the mountability of the external gear pump 1 on the vehicle that is a target apparatus on which the external gear pump 1 is mounted.

Even if one gear out of the primary gear 21 and the secondary gear 22 cannot rotationally be driven, the pump operation can be continued by continuing the rotational drive of the other gear. Thus, it is possible to satisfy the requirements of redundancy in ISO 26262 that is defined as a functional safety standard for automobiles.

Next, a second embodiment of the present invention is described with reference to FIG. 5 and FIG. 6. In the first embodiment, description is given of the case where the first electric motor 11 and the second electric motor 12 rotate the primary gear 21 and the secondary gear 22 in one direction, respectively. In this embodiment, the first electric motor 11 and the second electric motor 12 can rotate the primary gear 21 and the secondary gear 22 in two directions (forward direction and reverse direction), respectively. In the first embodiment, description is given of the case where the rotation angle sensor 57 is provided in each of the first electric motor 11 and the second electric motor 12. In this embodiment, description is given of a case where the rotation angle sensor 57 is not provided in the second electric motor 12.

Figure 5:
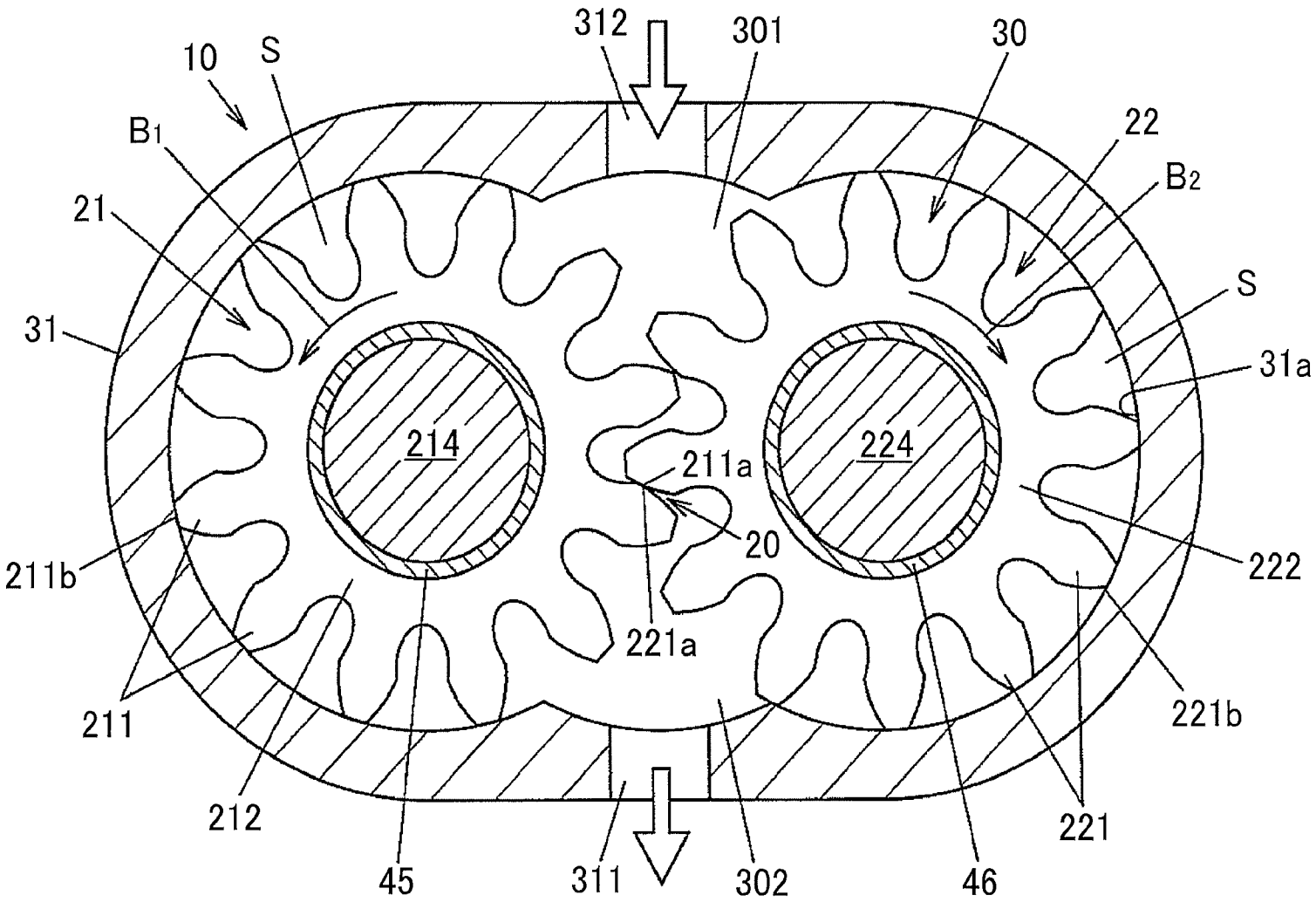
FIG. 5 is an explanatory drawing for describing an operation of an external gear pump when a first electric motor and a second electric motor rotate in reverse directions according to a second embodiment of the present invention.

FIG. 5 is an explanatory drawing for describing an operation of the external gear pump 1 when the first electric motor 11 and the second electric motor 12 rotate the primary gear 21 and the secondary gear 22 in the reverse directions (directions indicated by arrows $B_1$ and $B_2$), respectively. Also when the first electric motor 11 and the second electric motor 12 rotate in reverse directions, the control unit 13 controls the first and second electric motors 11 and 12 so that the torque generated by the first electric motor 11 is greater than the torque generated by the second electric motor 12. In this case, the suction direction and the discharge direction of the hydraulic oil are reversed, and the low-pressure chamber 301 and the high-pressure chamber 302 in the pump chamber 30 are reversed.

FIG. 6 is a schematic configuration diagram illustrating an example of the configuration of the control unit 13 according to this embodiment. Similarly to the first embodiment, when the CPU executes the program stored in advance, the control unit 13 functions as the speed control units 71 and 81, the current control units 72 and 82, the two-phase/three-phase conversion units 73 and 83, the PWM control units 74 and 84, the phase calculation units 75 and 85, the three-phase/two-phase conversion units 76 and 86, the speed calculation units 77 and 87, the command speed difference calculation unit 78, and the subtraction unit 88. In this embodiment, the CPU of the control unit 13 also functions as a rotational direction detection unit 79 and a rotation angle calculation unit 89. Operations of the control unit 13 according to this embodiment that are different from those of the first embodiment are described below.

In this embodiment, the control unit 13 controls the first electric motor 11 based on a rotation angle detected by the rotation angle sensor 57 of the first electric motor 11, and controls the second electric motor 12 based on a rotation angle of the second electric motor 12 that is calculated based on the rotation angle detected by the rotation angle sensor 57 of the first electric motor 11. That is, the primary gear 21 and the secondary gear 22 rotate such that the external teeth 211 and 221 mesh with each other, and therefore the first electric motor 11 and the second electric motor 12 constantly rotate at the same speed except for a timing when the rotational directions are reversed. In this embodiment, the second electric motor 12 is controlled by utilizing this fact. Thus, the rotation angle sensor 57 of the second electric motor 12 can be omitted.

The rotational direction detection unit 79 detects the rotational directions of the first and second electric motors 11 and 12 based on the rotation speed command ω*. For example, when the rotation speed command ω* is a positive value ($\omega^*>0$), the rotational direction detection unit 79 determines that the rotational directions of the first and second electric motors 11 and 12 are forward directions. When the rotation speed command ω* is a negative value ($\omega^*<0$), the rotational direction detection unit 79 determines that the rotational directions of the first and second electric motors 11 and 12 are reverse directions.

The rotation angle calculation unit 89 subtracts an offset amount from the rotation angle detected by the rotation angle sensor 57 of the first electric motor 11. The offset amount is a phase difference of an electrical angle when the rotational directions of the first and second electric motors 11 and 12 are forward directions. When the rotational directions of the first and second electric motors 11 and 12 that are detected by the rotational direction detection unit 79 are reverse directions, the rotation angle calculation unit 89 calculates the rotation angle of the second electric motor 12 by further subtracting a backlash amount corresponding to play of the meshing between the primary gear 21 and the secondary gear 22.

That is, when the rotational directions of the first and second electric motors 11 and 12 are forward directions, the control unit 13 controls the second electric motor 12 while the value obtained by subtracting the offset amount from the rotation angle detected by the rotation angle sensor 57 of the first electric motor 11 is set as the rotation angle $\theta_2$ of the second electric motor 12. When the rotational directions of the first and second electric motors 11 and 12 are reverse directions, the control unit 13 controls the second electric motor 12 while the value obtained by subtracting the offset amount and the backlash amount from the rotation angle detected by the rotation angle sensor 57 of the first electric motor 11 is set as the rotation angle $\theta_2$ of the second electric motor 12.

For example, the offset amount is measured and stored in the non-volatile memory of the control unit 13 after the motor shaft 51 of the first electric motor 11 is coupled to the primary gear 21, the motor shaft 51 of the second electric motor 12 is coupled to the secondary gear 22, and the primary gear 21 and the secondary gear 22 are meshed with each other in the pump housing 3. As the backlash amount, a fixed value may be used based on specifications of the primary gear 21 and the secondary gear 22 and a distance between the rotation axes $O_1$ and $O_2$.

As described above, in this embodiment, when the rotational directions of the first and second electric motors 11 and 12 are changed from the forward directions to the reverse directions, the rotation angle of the second electric motor 12 is calculated in consideration of the backlash amount of the primary gear 21 and the secondary gear 22 for the rotation angle detected by the rotation angle sensor 57 of the first electric motor 11, and the second electric motor 12 is controlled based on the calculated rotation angle.

According to the second embodiment described above, the rotation angle sensor 57 of the second electric motor 12 can be omitted. Thus, cost reduction and downsizing of the external gear pump 1 can be achieved in addition to the actions and effects of the first embodiment.

In the second embodiment described above, description is given of the case where the rotation angle sensor 57 of the second electric motor 12 is omitted. Conversely, the rotation angle sensor 57 may be provided in the second electric motor 12, and the rotation angle sensor 57 of the first electric motor 11 may be omitted. In this case, when the rotational directions of the first and second electric motors 11 and 12 are forward directions, the control unit 13 controls the first electric motor 11 while a value obtained by subtracting the offset amount from the rotation angle detected by the rotation angle sensor 57 of the second electric motor 12 is set as the rotation angle $\theta_1$ of the first electric motor 11. When the rotational directions of the first and second electric motors 11 and 12 are reverse directions, the control unit 13 controls the first electric motor 11 while a value obtained by subtracting the offset amount and the backlash amount from the rotation angle detected by the rotation angle sensor 57 of the second electric motor 12 is set as the rotation angle $\theta_1$ of the first electric motor 11. Thus, cost reduction and downsizing of the external gear pump 1 can be achieved similarly to the case where the rotation angle sensor 57 of the second electric motor 12 is omitted.

Next, a third embodiment of the present invention is described with reference to FIG. 7. In the first embodiment, description is given of the case where the first electric motor 11 is arranged on one side in the axial direction of the pump chamber 30 and the second electric motor 12 is arranged on the other side in the axial direction of the pump chamber 30. In this embodiment, both the first and second electric motors 11 and 12 are arranged on one side of the pump chamber 30.

Figure 7:
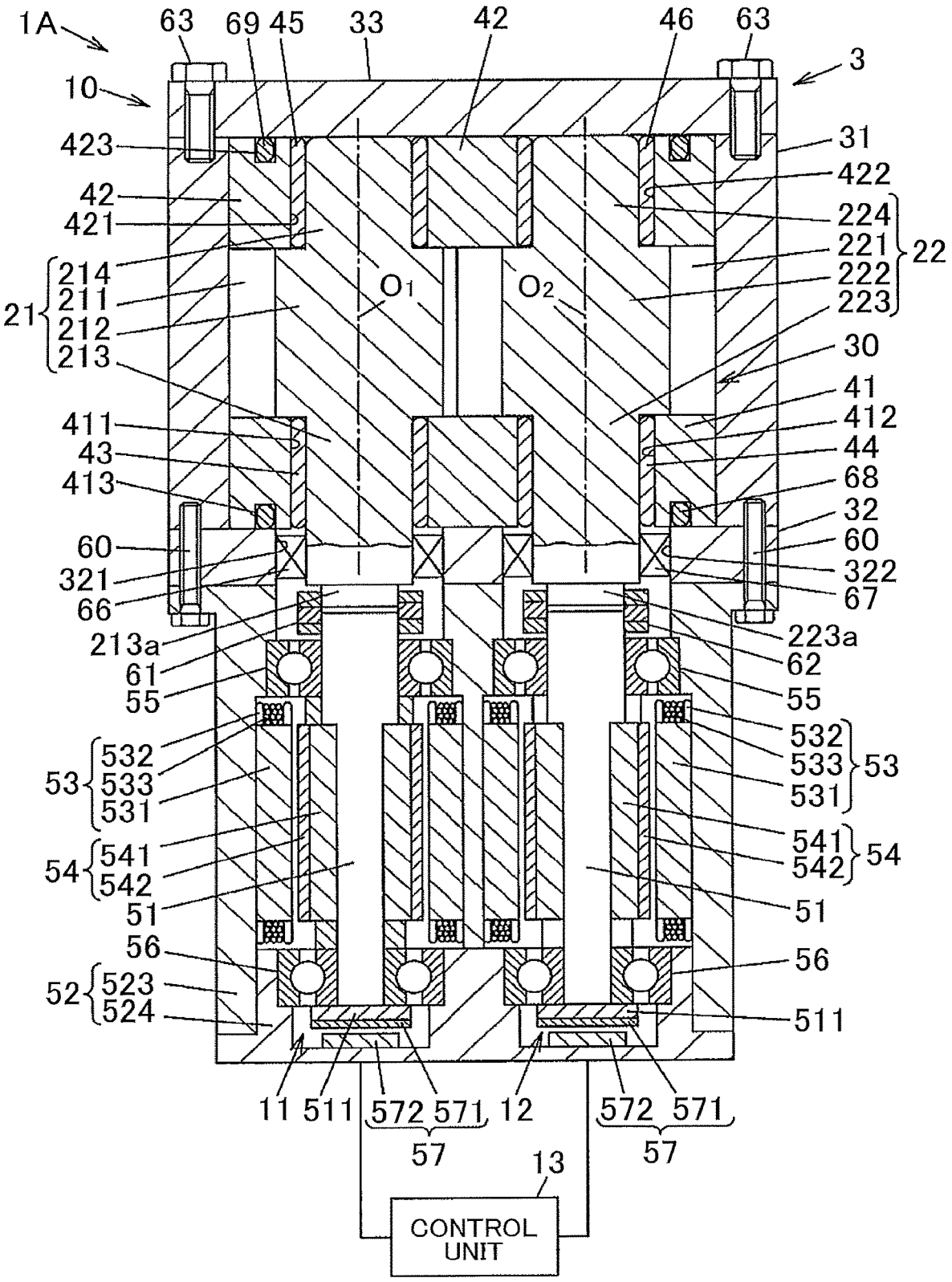
FIG. 7 is a sectional view illustrating an external gear pump according to a third embodiment of the present invention.

FIG. 7 is a sectional view illustrating an external gear pump 1A according to the third embodiment. In FIG. 7, components in common with those of the external gear pump 1 according to the first embodiment are represented by the same reference symbols as those in FIG. 1 to omit redundant description. The structure of the external gear pump 1A according to the third embodiment that is different from that of the first embodiment is mainly described below.

In this embodiment, the first electric motor 11 and the second electric motor 12 share the motor housing 52. The motor housing 52 includes a tubular body 523 and a lid 524. The body 523 houses the stators 53 of the first and second electric motors 11 and 12. The lid 524 closes one end of the body 523. The body 523 is fixed to the first side plate portion 32 of the pump housing 3 with a plurality of bolts 60. The bolts 60 threadedly engage with the tubular portion 31 through the first side plate portion 32.

The insertion hole 321 and an insertion hole 322 are formed in the first side plate portion 32. The first shaft portion 213 of the primary gear 21 is inserted through the insertion hole 321. The first shaft portion 223 of the secondary gear 22 is inserted through the insertion hole 322. The seal member 67 is arranged between the inner peripheral surface of the insertion hole 322 and the outer peripheral surface of the first shaft portion 223 of the secondary gear 22. A distal end 223*a* of the first shaft portion 223 of the secondary gear 22 is coupled to the motor shaft 51 of the second electric motor 12 by the coupling 62.

The core 531 of the stator 53 of the first electric motor 11 and the core 531 of the stator 53 of the second electric motor 12 are arranged side by side in a radial direction in the body 523 of the motor housing 52. The outside diameter of the core 531 of the stator 53 of the first electric motor 11 is smaller than the pitch diameter of the primary gear 21. The outside diameter of the core 531 of the stator 53 of the second electric motor 12 is smaller than the pitch diameter of the secondary gear 22. Thus, the cores 531 of the first and second electric motors 11 and 12 are housed in the motor housing 52 without interfering with each other.

The control unit 13 of the external gear pump 1A controls the first and second electric motors 11 and 12 similarly to the first embodiment.

According to the third embodiment described above, both the first and second electric motors 11 and 12 are arranged on one side of the pump chamber 30 as compared to the external gear pump 1 according to the first embodiment. Thus, the mountability of the external gear pump 1A on the vehicle can further be improved.

What is claimed is:

1. An external gear pump, comprising:

a pump housing in which a pump chamber is formed;

a first gear having a plurality of external teeth housed in the pump chamber;

a second gear having a plurality of external teeth that mesh with the plurality of external teeth of the first gear in the pump chamber;

a first electric motor configured to generate a torque for rotationally driving the first gear;

a second electric motor configured to generate a torque for rotationally driving the second gear; and a control unit configured to control the first electric motor and the second electric motor so that the torque generated by the first electric motor is greater than the torque generated by the second electric motor, one electric motor alone out of the first electric motor and the second electric motor is provided with a rotation angle sensor configured to detect a rotation angle of a rotation shaft of the one electric motor, and the control unit is configured to control the one electric motor based on the rotation angle detected by the rotation angle sensor, and to control the other electric motor based on a rotation angle of a rotation shaft of the other electric motor that is calculated based on the detected rotation angle.

2. The external gear pump according to claim 1, wherein the first electric motor is arranged on one side of the pump chamber in an axial direction parallel to rotation axes of the first gear and the second gear, and the second electric motor is arranged on the other side of the pump chamber in the axial direction.

3. The external gear pump according to claim 1, wherein the first electric motor and the second electric motor are arranged on one side of the pump chamber in an axial direction parallel to rotation axes of the first gear and the second gear.

4. The external gear pump according to claim 1, wherein, when a failure occurs such that the first gear cannot rotationally be driven by the first electric motor, the control unit is configured to cause the second gear to rotate by controlling the second electric motor, and to cause the first gear to rotate by meshing between the first gear and the second gear.

5. The external gear pump according to claim 1, wherein, when a failure occurs such that the second gear cannot rotationally be driven by the second electric motor, the control unit is configured to cause the first gear to rotate by controlling the first electric motor, and to cause the second gear to rotate by meshing between the second gear and the first gear.

6. The external gear pump according to claim 1, wherein, when rotational directions of the first electric motor and the second electric motor are changed from forward directions to reverse directions, the control unit is configured to calculate the rotation angle of the rotation shaft of the other electric motor in consideration of a backlash amount of the first gear and the second gear for the rotation angle detected by the rotation angle sensor, and to control the other electric motor based on the calculated rotation angle.

7. The external gear pump according to claim 1, wherein at least one external tooth of the first gear is in contact with at least one external tooth of the second gear.

8. The external gear pump according to claim 7, wherein the contact between the at least one external tooth of the first gear and the at least one external tooth of the second gear forms a seal portion that defines a low-pressure chamber and a high-pressure chamber relative to the low-pressure chamber.

* * * * *